US008259983B2

(12) United States Patent
Nedelcu

(10) Patent No.: US 8,259,983 B2
(45) Date of Patent: Sep. 4, 2012

(54) ANTI-VIBRATION IN-CEILING SPEAKER SYSTEM

(76) Inventor: Eugen Nedelcu, Meridian, ID (US)

( * ) Notice: Subject to any disclaimer, the term of this patent is extended or adjusted under 35 U.S.C. 154(b) by 392 days.

(21) Appl. No.: 12/551,353

(22) Filed: Aug. 31, 2009

(65) Prior Publication Data

US 2011/0051971 A1 Mar. 3, 2011

(51) Int. Cl.
*H04R 1/02* (2006.01)

(52) U.S. Cl. ..... 381/354; 381/392

(58) Field of Classification Search ..... 381/349, 381/354, 392, 152, 89, 182, 186, 332, 334, 381/335, 386; 340/326; 181/144, 145, 147, 181/150, 199

See application file for complete search history.

(56) References Cited

U.S. PATENT DOCUMENTS

| | | | | |
|---|---|---|---|---|
| 3,720,787 | A | 3/1973 | Ishii | |
| 4,030,563 | A | 6/1977 | Zinna | |
| 4,031,318 | A | 6/1977 | Pitre | |
| 4,673,057 | A | 6/1987 | Glassco | |
| 4,836,326 | A | 6/1989 | Wehner | |
| 4,850,452 | A | 7/1989 | Wolcott | |
| 4,891,346 | A | 1/1990 | Hucul | |
| 4,891,842 | A | 1/1990 | Green | |
| 5,025,473 | A | 6/1991 | Carlsen, II | |
| 5,073,945 | A | 12/1991 | Kageyama | |
| 5,097,514 | A | 3/1992 | McNeill | |
| 5,436,976 | A | 7/1995 | Dougherty | |
| 5,561,717 | A | 10/1996 | Lamm | |
| 6,257,365 | B1 | 7/2001 | Hulsebus, II | |
| 2007/0222631 | A1* | 9/2007 | Haase | 340/691.5 |
| 2008/0080727 | A1* | 4/2008 | Prenta et al. | 381/152 |
| 2008/0199033 | A1* | 8/2008 | Decanio | 381/349 |

* cited by examiner

*Primary Examiner* — Yuwen Pan
*Assistant Examiner* — Phan Le
(74) *Attorney, Agent, or Firm* — TraskBritt

(57) ABSTRACT

Disclosed is a speaker system for installation within a ceiling, wall, or other structure. The speaker system includes at least one pair of woofers housed by a woofer housing. The two woofers of each pair are oppositely arranged relative to one another so that the vibrations generated by each during operation are essentially neutralized or eliminated. Attached to the woofer housing is a mounting frame to which is attached a driver, such as a tweeter, a combination tweeter and midrange, or another woofer. This driver is perpendicularly arranged to a woofer pair. When installed, the woofers are positioned within the ceiling or other structure in which the system is installed.

17 Claims, 16 Drawing Sheets

ANTI-VIBRATION IN-CEILING SPEAKER SYSTEM

FIELD OF THE INVENTION

The present anti-vibration in-ceiling speaker system generally relates to speaker systems, and more particularly to bass-producing speaker systems for installation within the ceiling of a room.

BACKGROUND OF THE INVENTION

In-wall and in-ceiling mounted speaker assemblies are quite popular. However, known speaker assemblies mounted in this manner, such as that depicted in FIG. 15*a*, either provide little in the way of bass sounds or cause an unpleasant side effect by vibrating or rattling the walls and ceilings in which the system is mounted, as shown in FIG. 15*b*. This is because bass-producing loudspeakers, i.e., woofers 22', produce low-frequency sound waves through the back-and-forth movement of a driver's diaphragm, indicated by arrow 52'. The movement of the driver's diaphragm necessarily results in movement of the surrounding environment of the woofer. That is, the vibrations of the diaphragm transfer to the woofer's frame and eventually transfer into the mounting panel to which the speaker system is mounted. Thus, for in-ceiling or in-wall mounted speakers, such as that shown in FIGS. 15*a* and 15*b*, for which the mounting panel is attached to or consists of the ceiling's or wall's surface 42, the vibrations generated by the diaphragm eventually transfer to the surrounding wall or ceiling 42, producing the unwanted rattling or vibrating thereof, as shown in FIG. 15*b*. The vibrations also generate unwanted and out-of-phase sound, which distorts and otherwise interferes with the main sound signal the loudspeaker itself produces. All this increases distortion levels in the bass frequencies of the loudspeaker system.

Another disadvantage to known speaker systems configured for providing significant bass sounds is the size of such systems. Woofers are generally much larger than higher frequency range loudspeaker drivers. Given the necessary large size of woofers, then, known speaker assemblies designed to provide a great deal of bass sound are generally large and therefore not conducive to in-wall or in-ceiling installations. As such, they take up space in rooms or on furniture that could otherwise be put to another use. Further, due largely because of the large size of woofers, speaker owners often place these bass-providing systems in corners of rooms or off to the side of a room, rather than near the middle of the room. Placing the systems at these locations inevitably leads to increased vibration or rattling of close-by walls, floors, and furniture.

The loudspeaker system disclosed in U.S. Pat. No. 5,561,717, attempts to avoid vibrations to the walls of a room for an in-wall installed bass speaker system by arranging the woofers in an enclosure so that the axis of each woofer intersects at a particular point, providing a port tube to allow the sound to exit out of the enclosure. This system, however, is limited in the range of sound wave frequencies producible. All of the woofers of the system are loudspeakers producing the same, low-range frequencies. This is necessary to provide the equal and opposite reaction on the enclosure from the symmetrically-arranged woofers. Thus, this known system provides only a one-way woofer system for bass sounds. It further does not have the aesthetic appeal of traditional in-wall or in-ceiling tweeter loudspeakers.

SUMMARY OF THE INVENTION

Embodiments of the present anti-vibration in-ceiling speaker system provide a multi-way or full-range speaker system with a significant amount of bass sound capability, has the same aesthetic appearance of a traditional in-ceiling loudspeaker system, and yet also minimizes or eliminates rattling and vibrating of neighboring walls and ceiling surfaces. As such, it can be installed in a room along with traditional in-ceiling loudspeakers without visual distinction.

In particular, the speaker system includes at least one pair of woofers housed by a woofer housing. The two woofers of each woofer pair are oppositely directed relative to one another. Attached to the woofer housing is a mounting frame having a top opening, which, when installed, is directed toward the interior of the room and thus toward the listener. Attached to the mounting frame is a driver chamber that holds a driver. The driver is arranged perpendicularly to the woofers. The mounting frame is configured to be mounted to the surface of a ceiling, and, when installed, the mounting frame is essentially flush to the surface of the ceiling, as is the face of the driver, which is directed essentially downward into the room. The woofers and woofer housing sit above the mounting frame, within the ceiling itself. In operation, sound produced by the woofers and the downward-facing driver may exit the speaker system via open space provided by the top opening in the mounting frame.

The driver of the speaker system may be any type of loudspeaker driver, such as a tweeter, a woofer, or a two-way combination of a tweeter within a mid-range. As such, the speaker system accommodates not only a great deal of bass sound, but also mid-range and high-range sounds. Further, because the face of the downward-facing driver is the only face of the speaker system easily visible from within the room in which the speaker system is installed, the speaker system has the same outward appearance as a traditional in-ceiling mounted single-driver loudspeaker.

The purpose of the Summary is to enable the public, and especially the scientists, engineers, and practitioners in the art who are not familiar with patent or legal terms or phraseology to determine quickly, from a cursory inspection, the nature and essence of the technical disclosure of the application. The Summary is neither intended to define the anti-vibration in-ceiling speaker system, which is measured by the claims, nor is it intended to be limiting in any way as to the scope of the system.

Still other features and advantages of the claimed system will become readily apparent to those skilled in the art from the following detailed description describing preferred embodiments of the system, simply by way of illustration of the best mode contemplated by carrying out the system. As will be realized, the system is capable of modification in various obvious respects all without departing from the invention. Accordingly, the drawings and description of the preferred embodiments are to be regarded as illustrative, and not restrictive.

DESCRIPTION OF THE PREFERRED EMBODIMENTS

Figure 1:
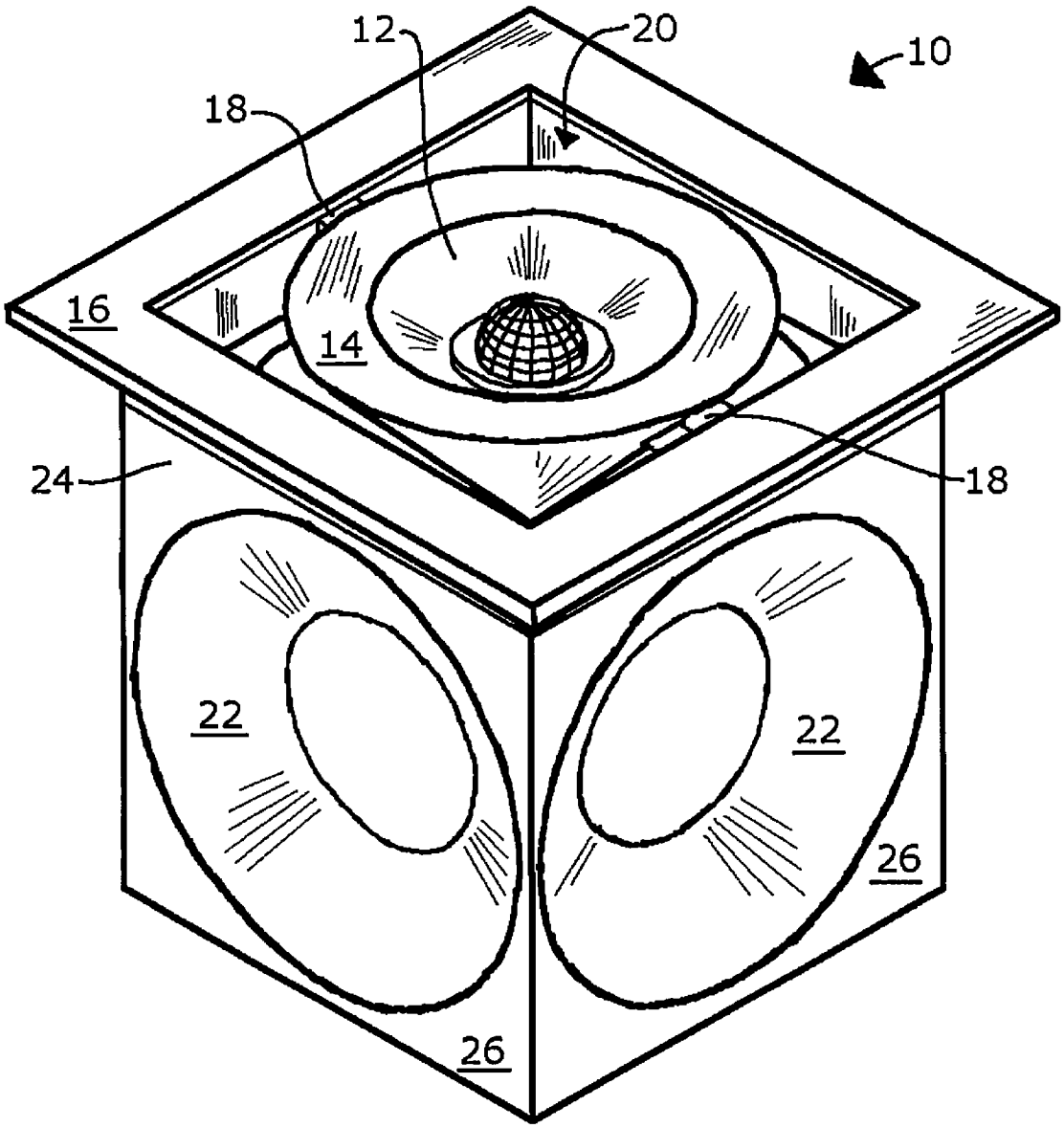
FIG. 1 is a perspective view of the top and two sides of the anti-vibration in-ceiling speaker system according to a first embodiment.
Figure 2:
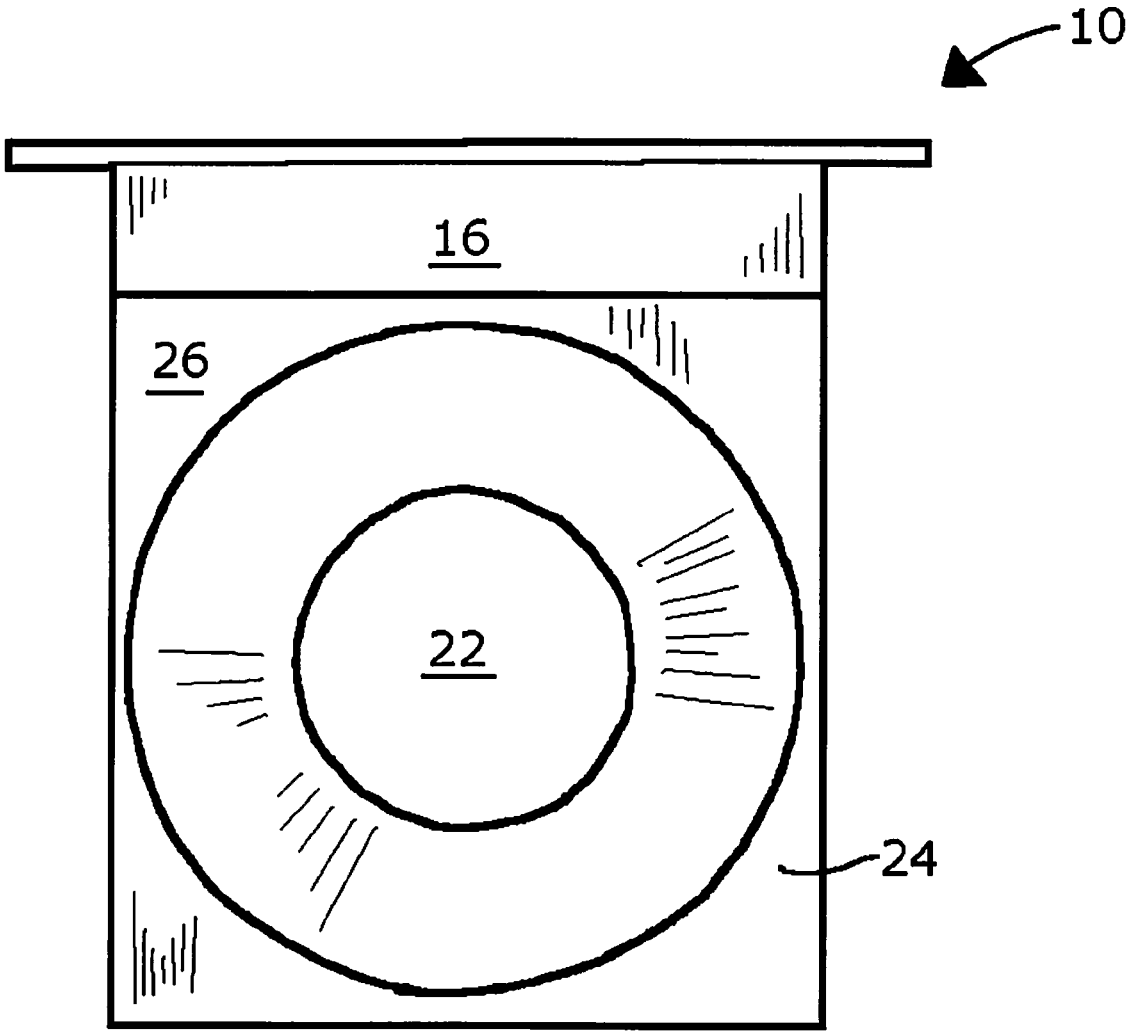
FIG. 2 is an elevation view of one side of the anti-vibration in-ceiling speaker system according to the first embodiment, the elevation views of the other three sides being the same.
Figure 3:
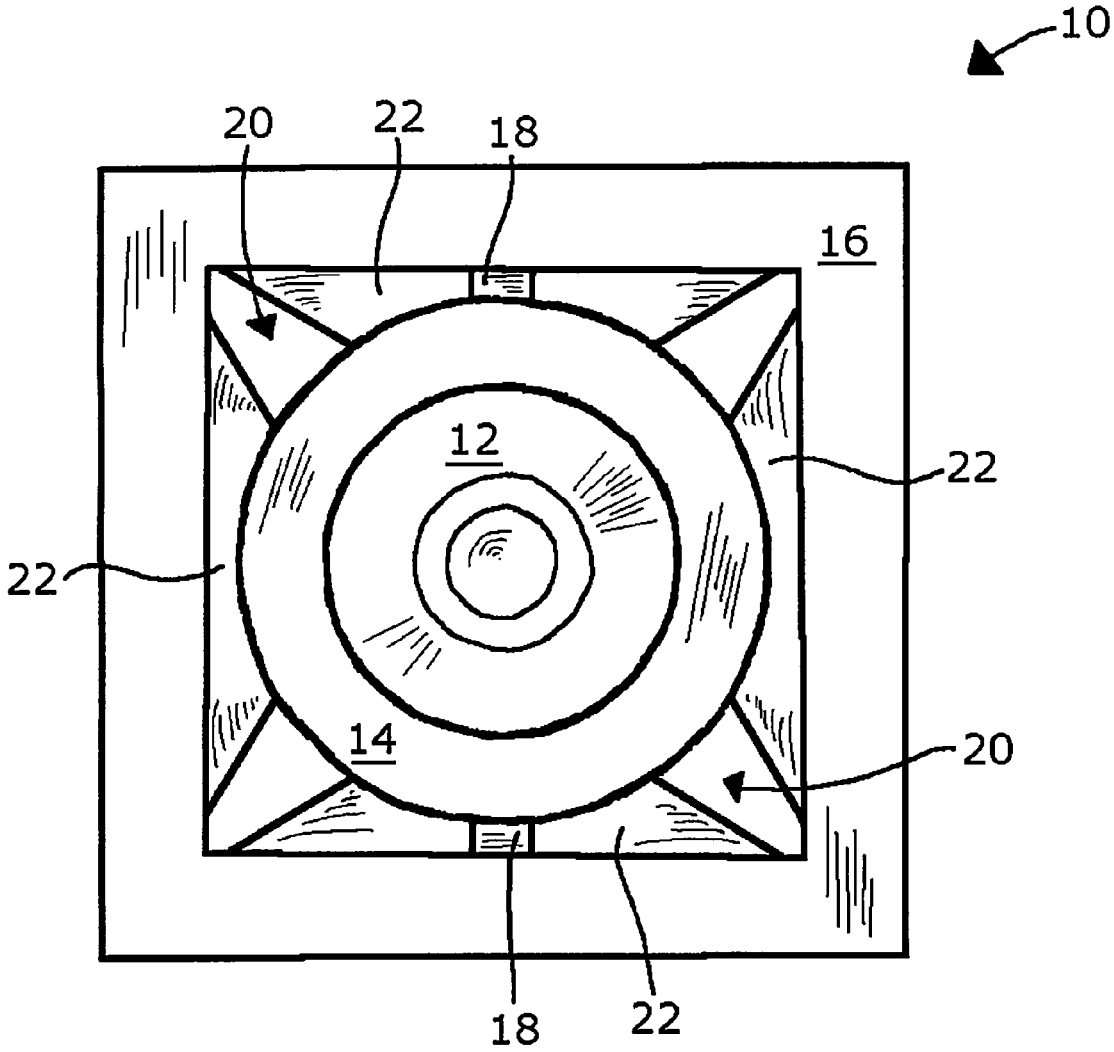
FIG. 3 is a top plan view of the anti-vibration in-ceiling speaker system according to the first embodiment.
Figure 4:
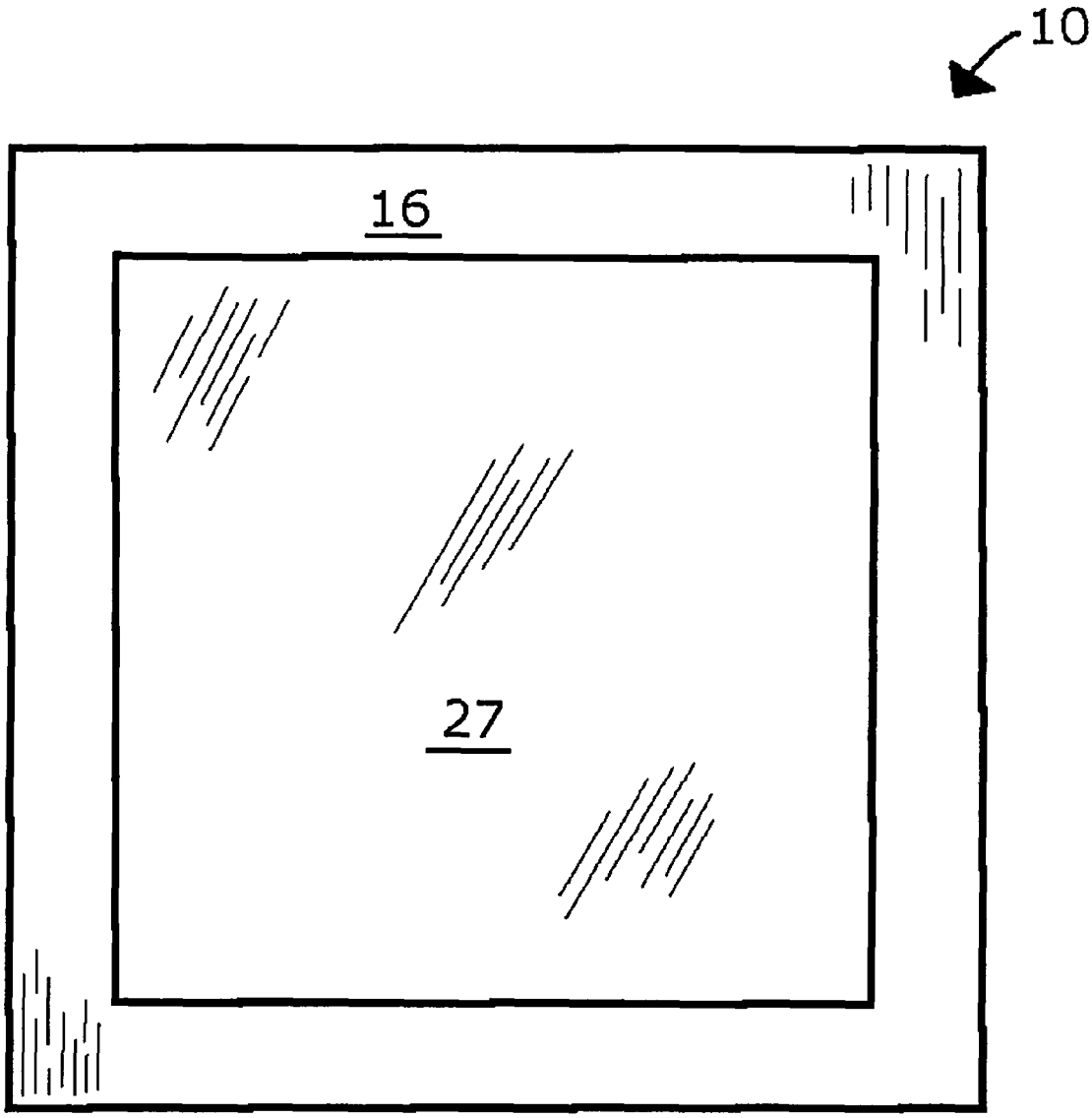
FIG. 4 is a bottom plan view of the anti-vibration in-ceiling speaker system according to the first embodiment.

While the system is susceptible of various modifications and alternative constructions, certain illustrated embodiments thereof have been shown in the drawings and will be described below in detail. It should be understood, however, that there is no intention to limit the system to the specific form disclosed, but, on the contrary, the anti-vibration in-ceiling speaker system is to cover all modifications, alternative constructions, and equivalents falling within the spirit and scope of the system as defined in the claims.

In the following description and in the figures, like elements are identified with like reference numerals. The use of "e.g.," "etc.," and "or" indicates non-exclusive alternatives without limitation unless otherwise noted. The use of "including" means "including, but not limited to," unless otherwise noted.

As shown in FIGS. 1 through 14, 15*c*, and 15*d*, for purposes of illustration, the anti-vibration in-ceiling speaker system 10 includes a woofer housing 24 and at least one pair of woofers 22 housed by the woofer housing 24. According to the first and second preferred embodiments, the woofer housing 24 includes a number of sides 26, each of which defines a woofer opening 28 (FIG. 8). Each of the woofer openings 28 is configured to receive therein a woofer 22 (FIG. 7). According to the depicted embodiments, the woofer housing 24 includes four sides 26 as well as a bottom 27, which are together arranged in a box shape, leaving one open surface, as shown in FIG. 7. While four sides 26 are depicted in the figures, in other embodiments, the woofer housing 24 includes more or fewer sides 24 and/or is arranged other than in a box shape.

Figure 5:
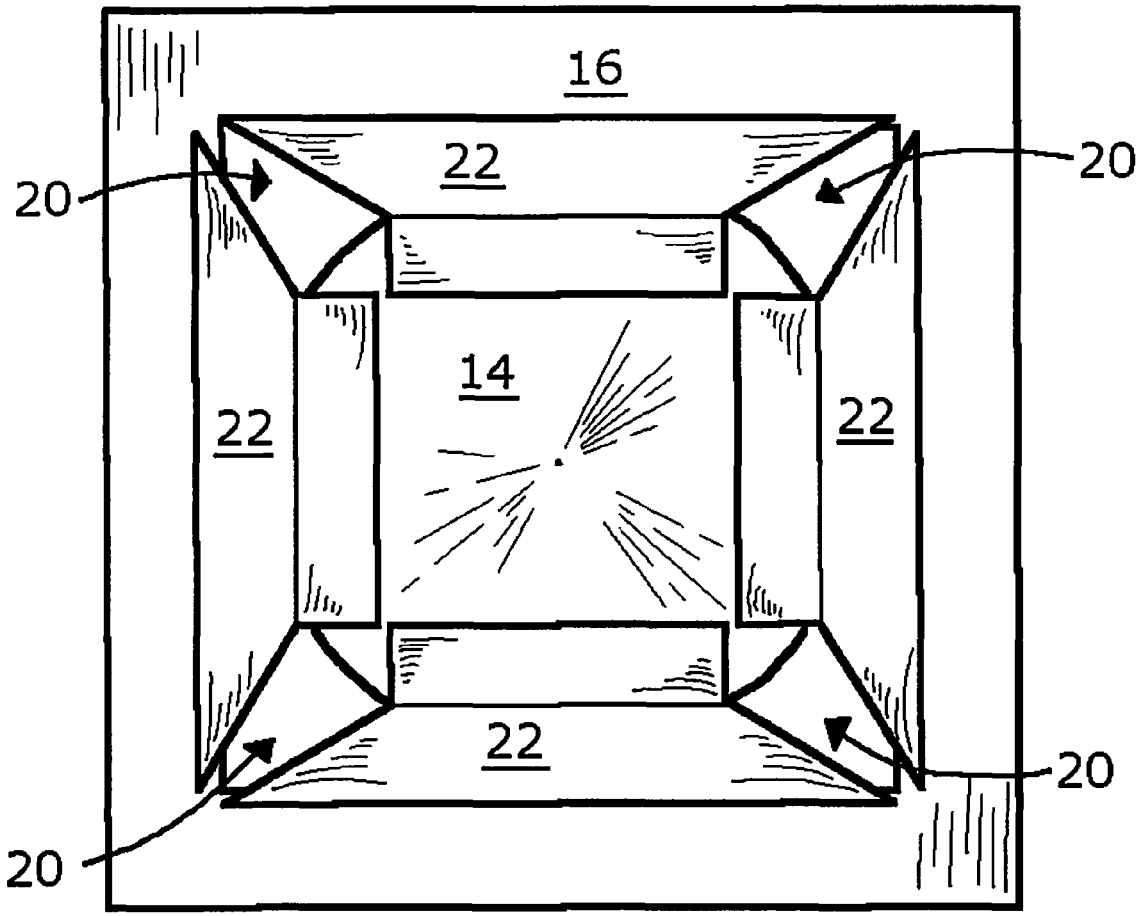
FIG. 5 is a bottom plan view of the anti-vibration in-ceiling speaker system according to the first embodiment, with the woofer housing removed for easier visibility of interior components.
Figure 6:
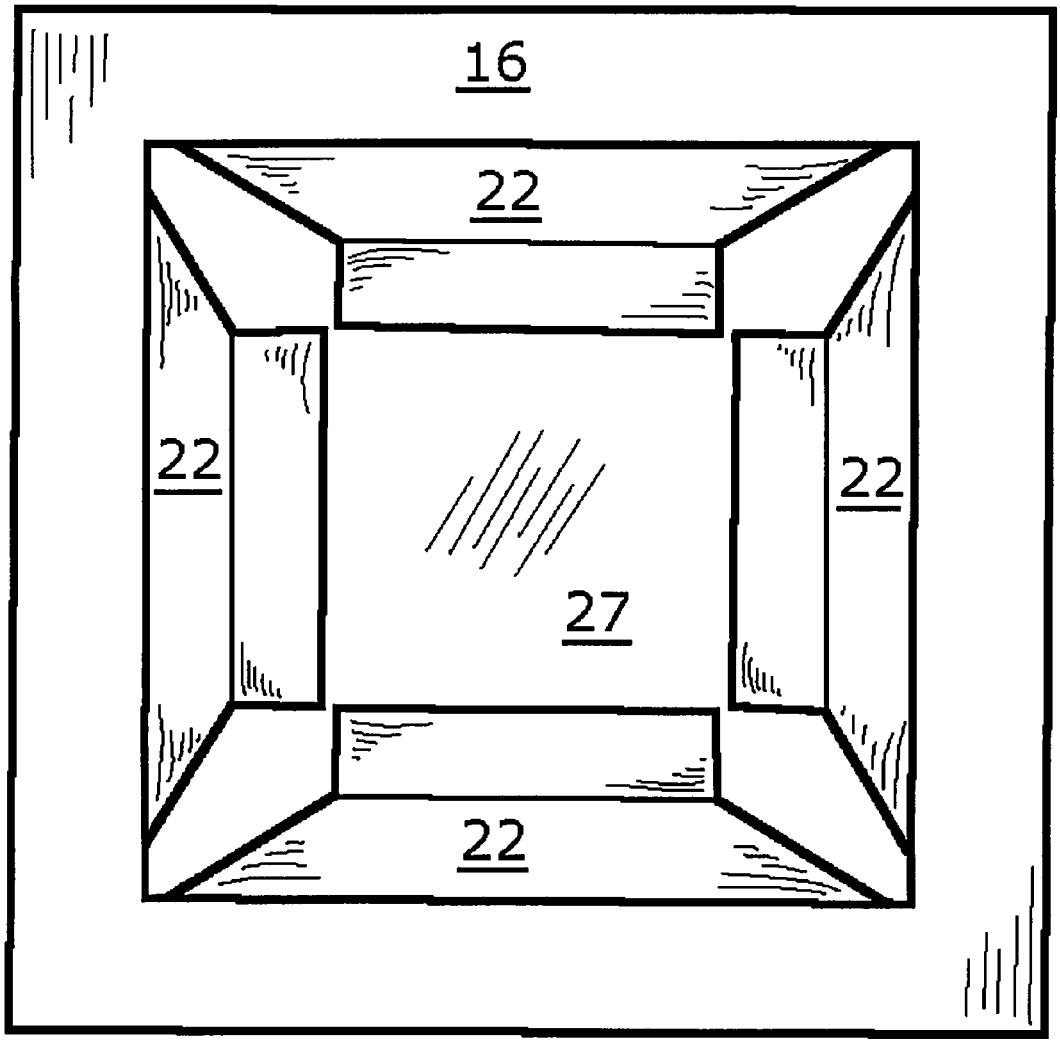
FIG. 6 is a top plan view of the anti-vibration in-ceiling speaker system according to the first embodiment, with the driver, driver chamber, and bridge removed for easier visibility of interior components.
Figure 7:
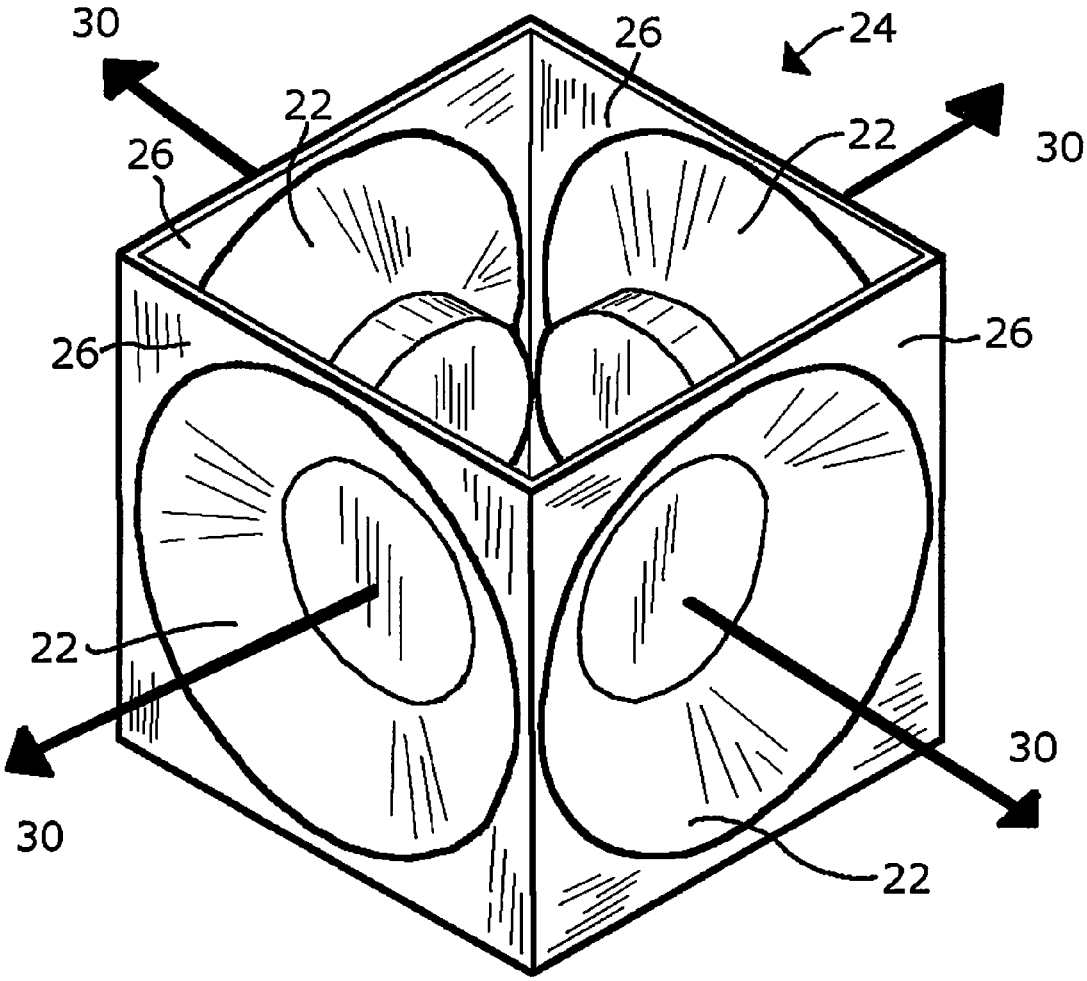
FIG. 7 is a perspective view of the top and two sides of the woofer housing and woofers of the anti-vibration in-ceiling speaker system according to the first embodiment and a second embodiment.
Figure 8:
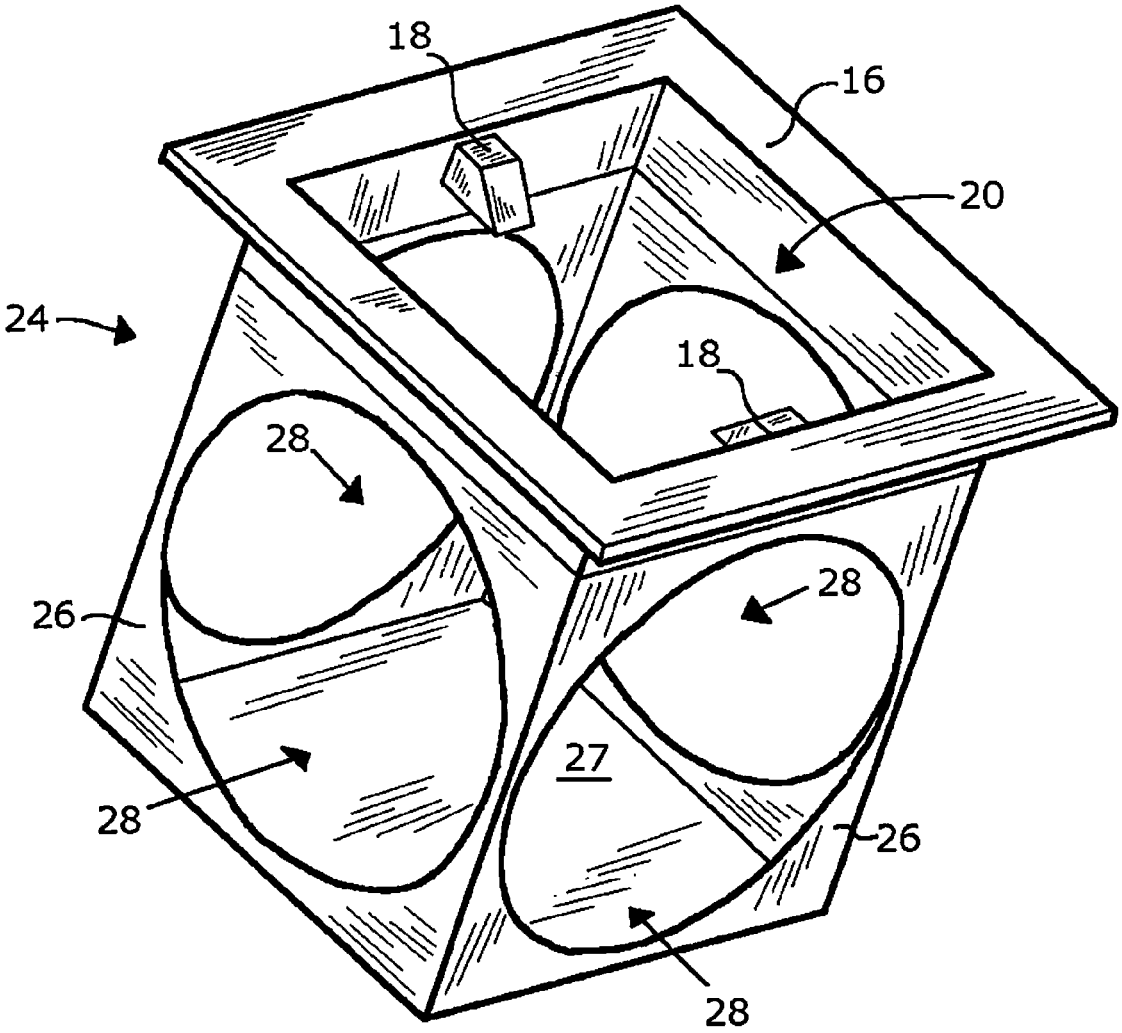
FIG. 8 is a perspective view of the top and two sides of the woofer housing, mounting frame, and bridge of the anti-vibration in-ceiling speaker system according to the first embodiment.
Figure 9:
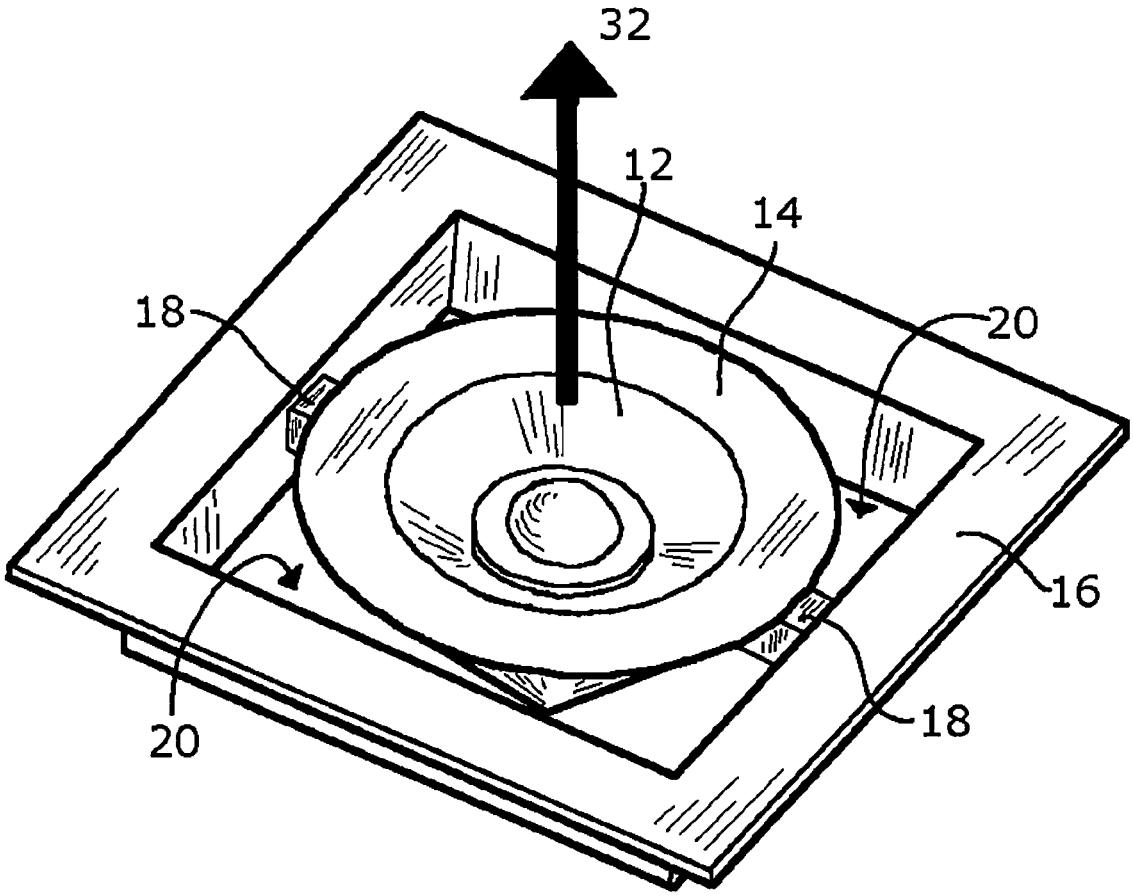
FIG. 9 is a perspective top view of the mounting frame, bridge, driver chamber, and driver of the anti-vibration in-ceiling speaker system according to the first embodiment.
Figure 10:
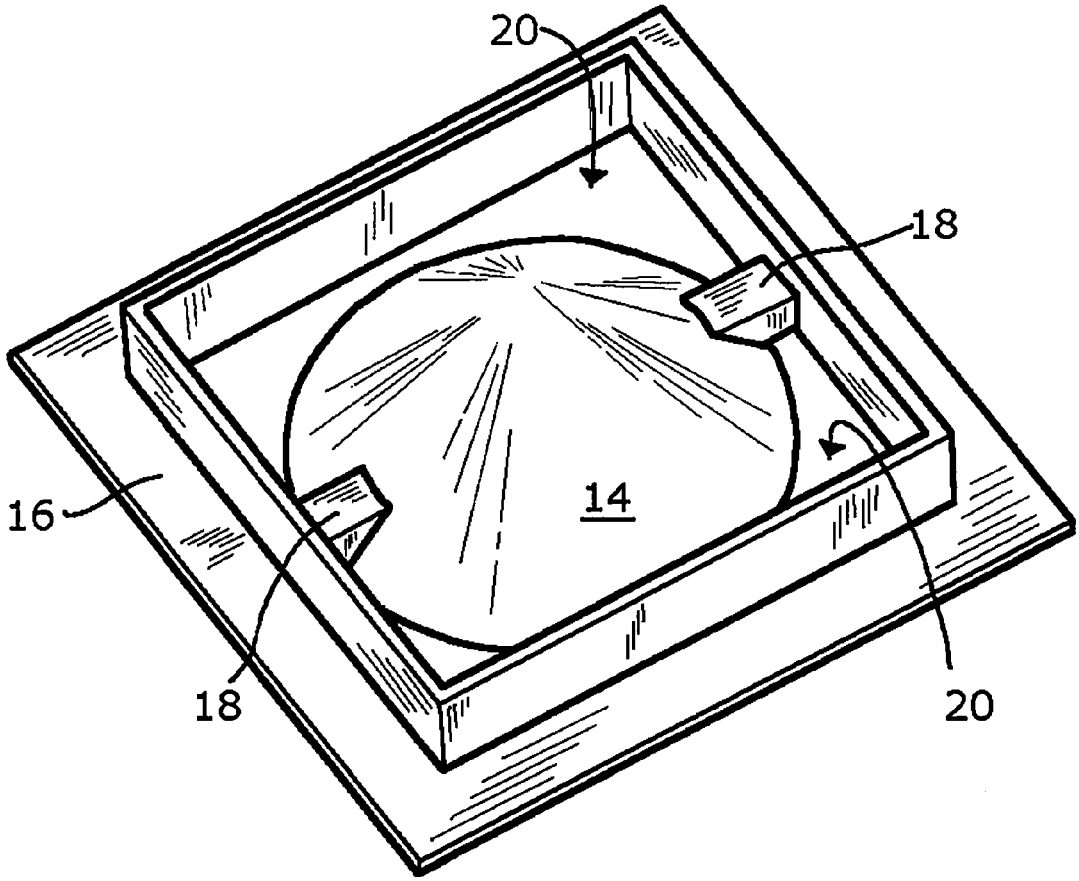
FIG. 10 is a perspective bottom view of the mounting frame, bridge, driver chamber, and driver of the anti-vibration in-ceiling speaker system according to the first embodiment.
Figure 11:
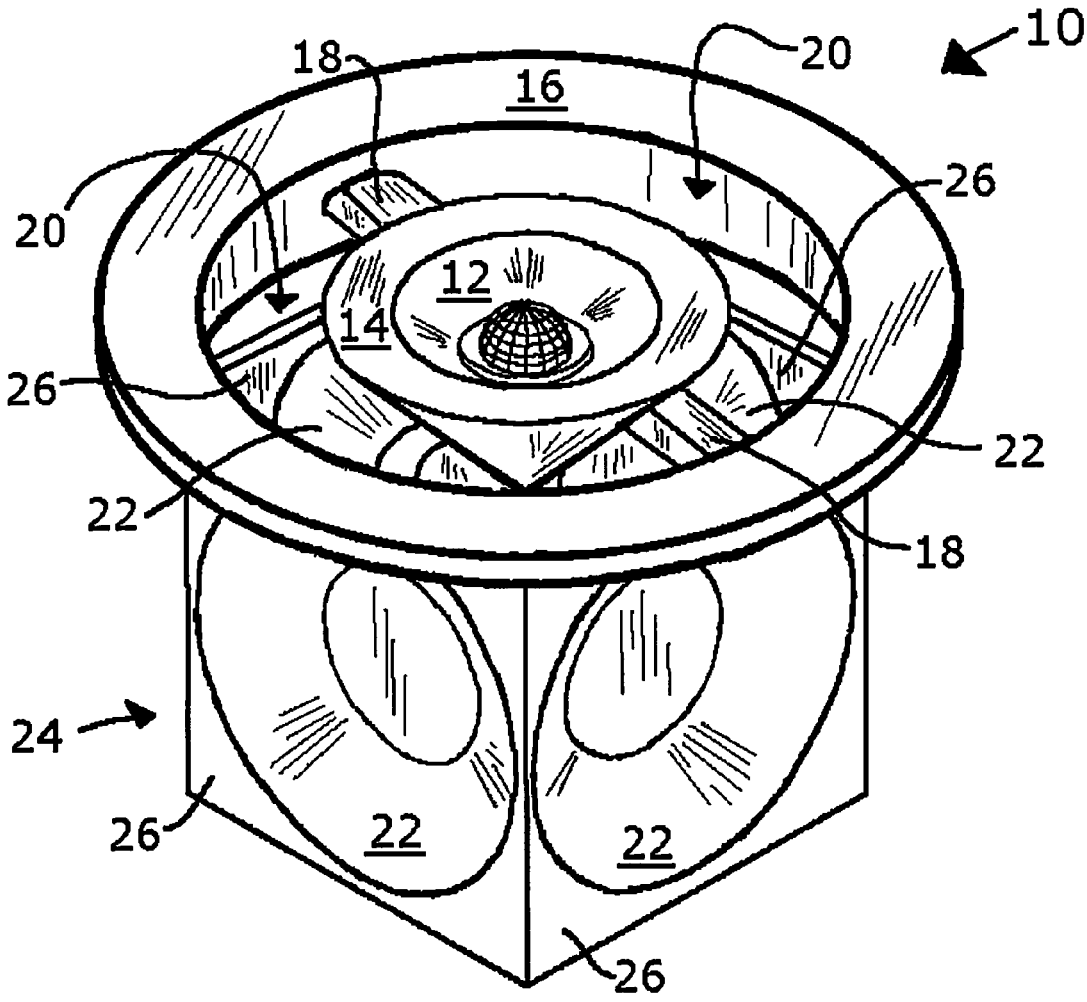
FIG. 11 is a perspective view of the top and two sides of the anti-vibration in-ceiling speaker system according to a second embodiment.
Figure 12:
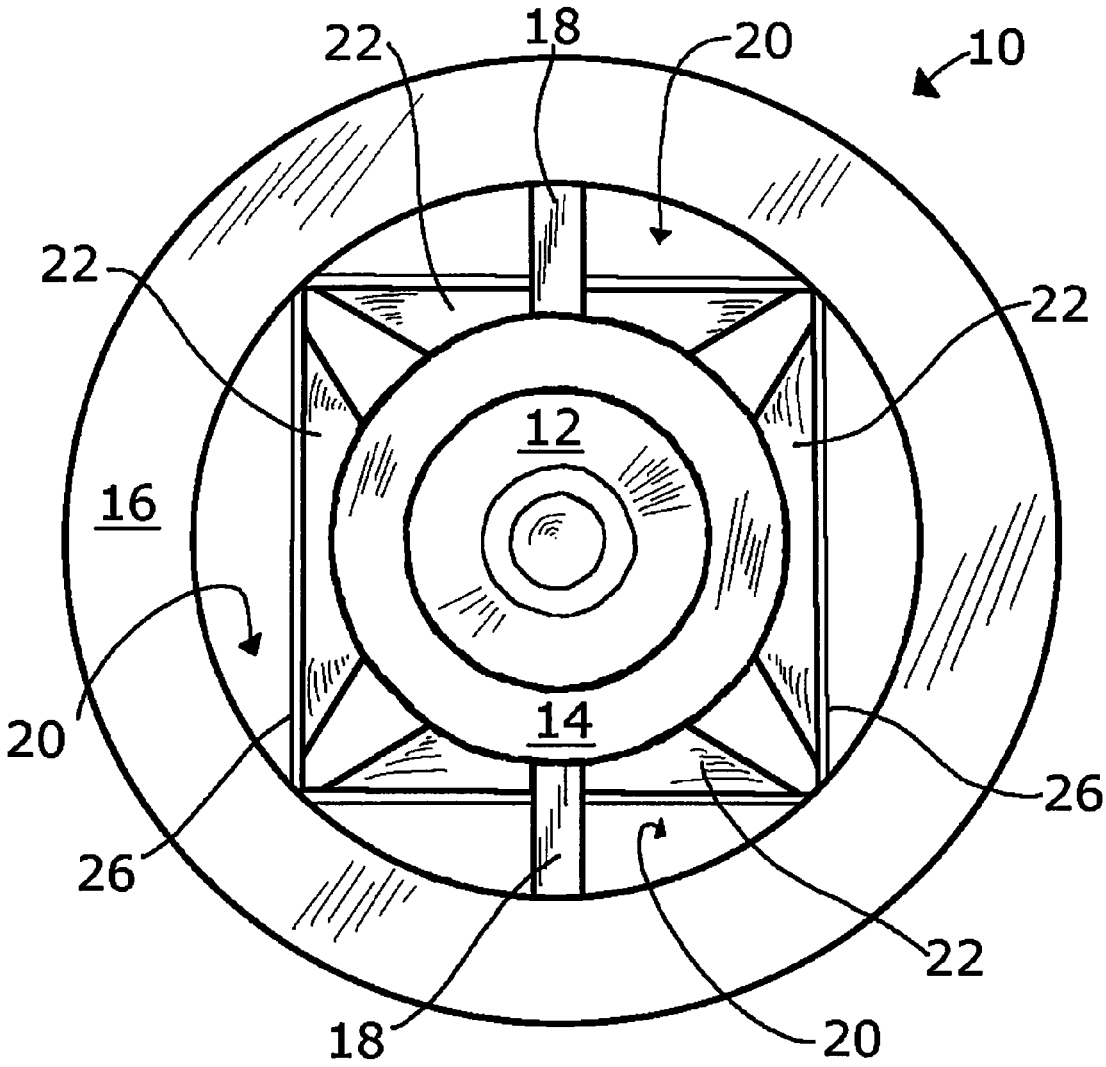
FIG. 12 is a top plan view of the anti-vibration in-ceiling speaker system according to the second embodiment.
Figure 13:
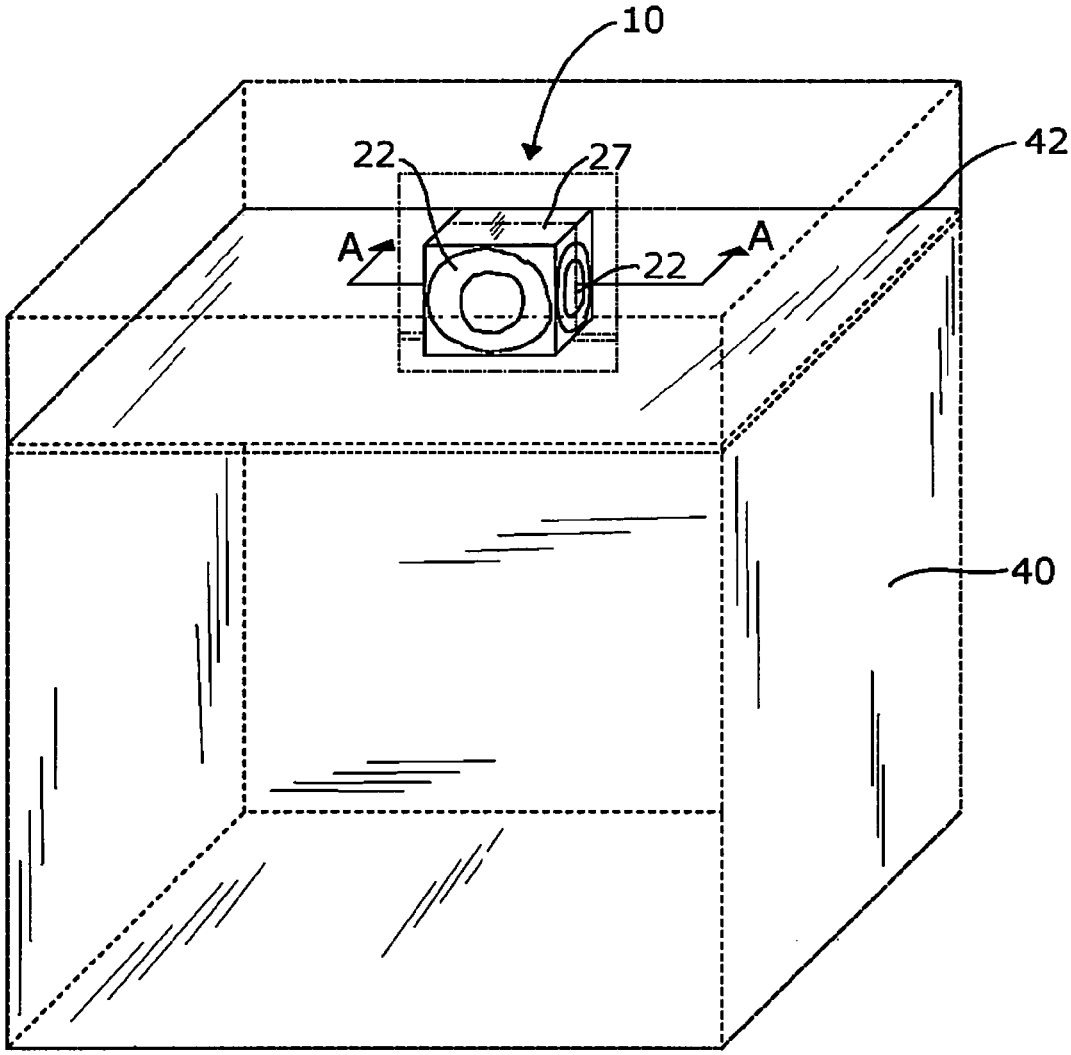
FIG. 13 is a perspective view from above of an installed anti-vibration in-ceiling speaker system according to the first and second embodiments.
Figure 14:
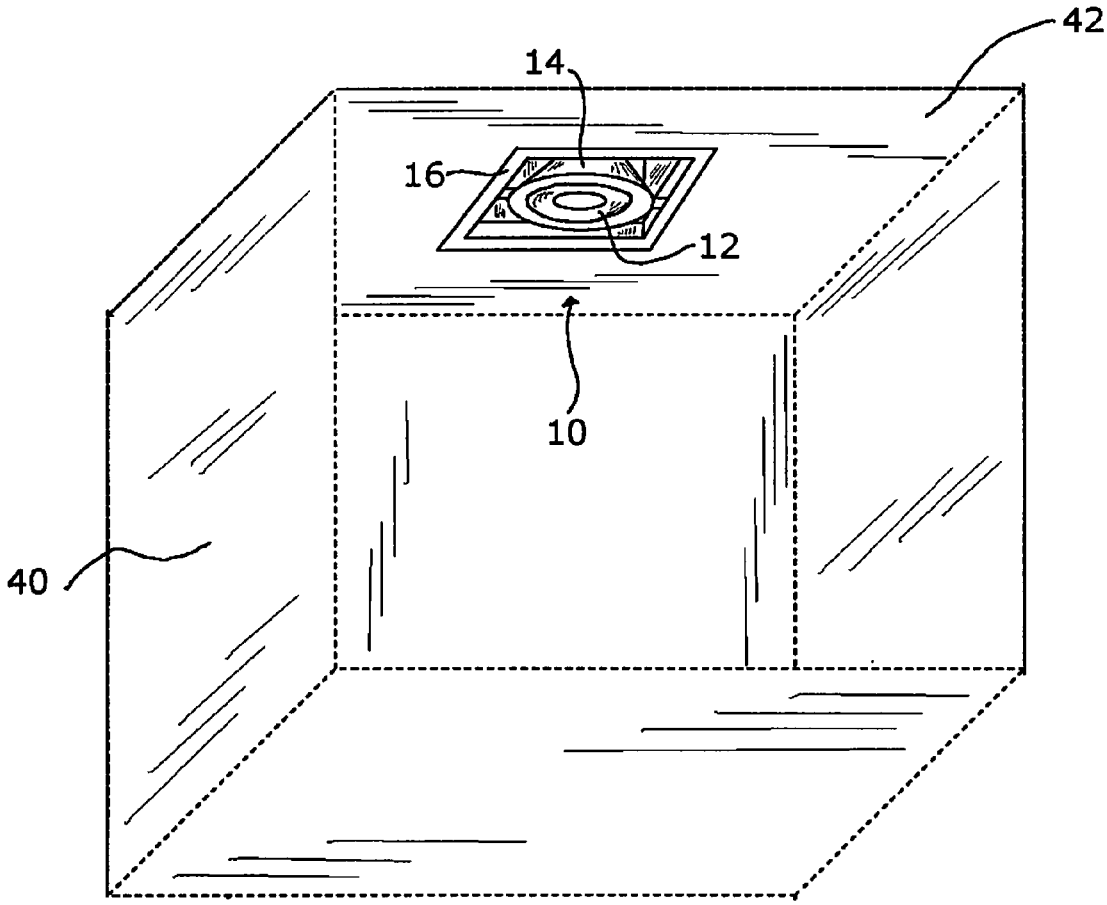
FIG. 14 is a perspective view from below of an installed anti-vibration in-ceiling speaker system according to the first embodiment.
Figure 15A:
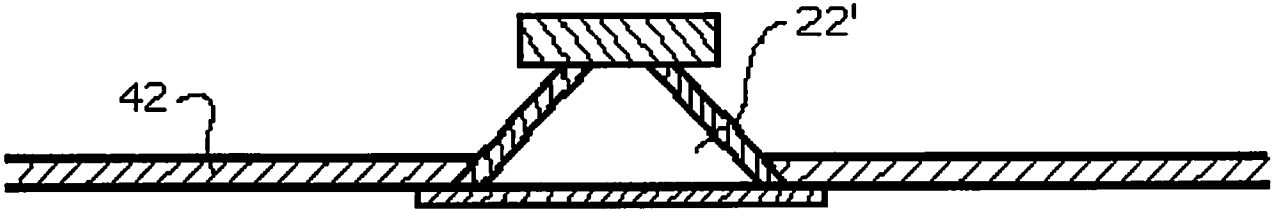
Figure 15a PRIOR ART
FIG. 15*a* is a sectional, elevation view of a prior art in-ceiling woofer.
Figure 15B:
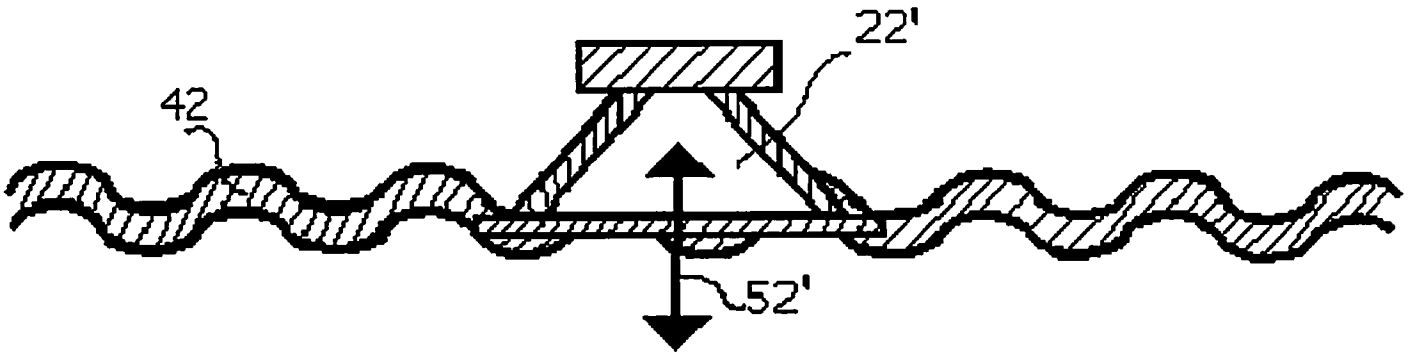
Figure 15b PRIOR ART
FIG. 15*b* is a sectional, elevation view of a prior art in-ceiling woofer during use.

Preferably, the speaker system 10 includes two pairs of woofers 22, as shown in FIGS. 1 through 14, and particularly in FIGS. 5 through 7. In other embodiments, the speaker system 10 includes only one pair of woofers 22, and in still other embodiments, the speaker system 10 includes more than two pairs of woofers 22. In any regard, the two woofers 22 of each pair of woofers 22 are arranged relative to one another so as to be oppositely directed, as indicated by arrows 30 in FIG. 7. Accordingly, during operation, the vibrations 50 generated by each woofer 22 are essentially equal and opposite to the vibrations 50 generated by another woofer 22 that is oppositely directed, as depicted by arrows 54 in FIG. 15*d*. As such, the vibrations 50 generated by one woofer 22 are essentially neutralized by the vibrations 50 generated by another woofer 22 and therefore do not significantly vibrate their surroundings, unlike the commonly-known in-ceiling woofers (FIGS. 15*a* and 15*b*).

Connected to the woofer housing 24 is a mounting frame 16, which defines a top opening 20. The mounting frame 16 and top opening 20 may be variously shaped, such as in a rectangular or square shape according to the first preferred embodiment (shown in FIGS. 1 through 6, 8 through 10, and 14) or in round or circular shape according to the second preferred embodiment (shown in FIGS. 11 and 12).

Figure 15D:
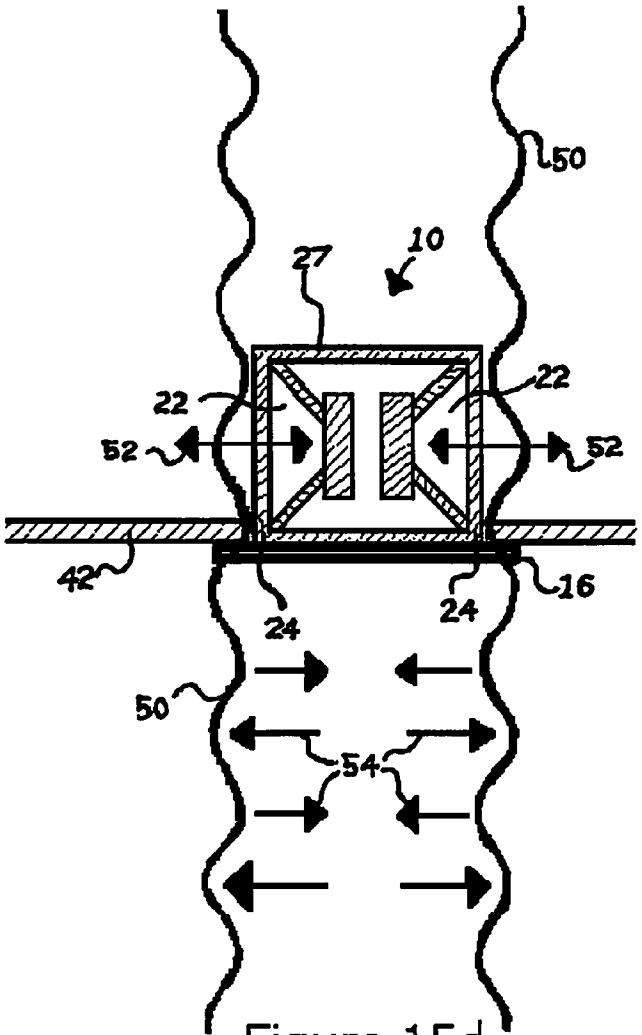
FIG. 15*d* is a sectional, elevation view of the installed anti-vibration in-ceiling speaker system as depicted in FIG. 13, taken along plane A.
Figure 15C:
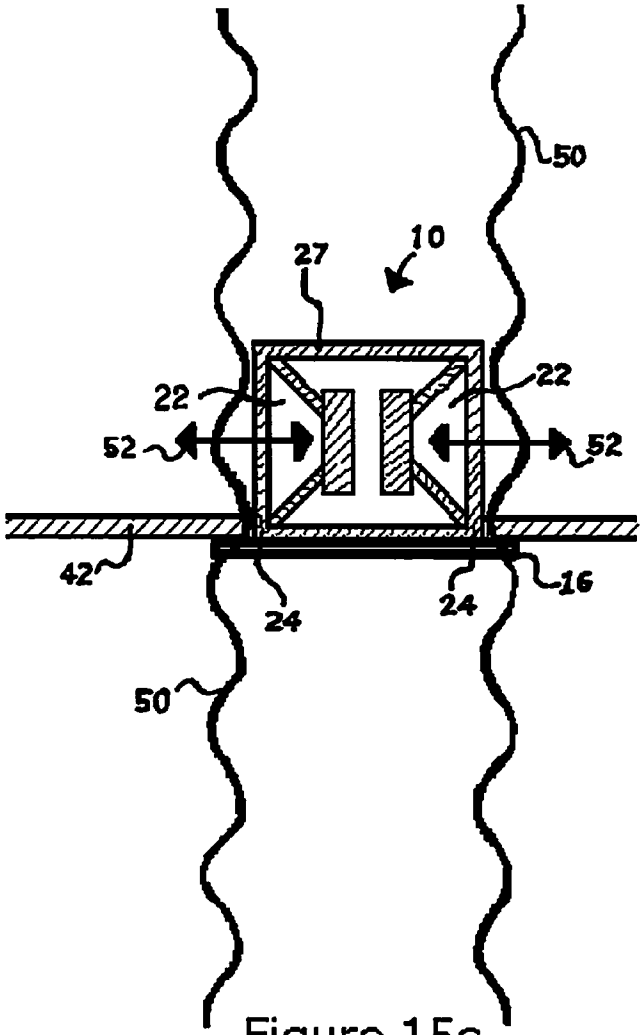
FIG. 15*c* is a sectional, elevation view of the installed anti-vibration in-ceiling speaker system as depicted in FIG. 13, taken along plane A.

The mounting frame 16 is configured to accommodate installation of the speaker system 10 in the ceiling 42 of a room 40. Preferably, the speaker system 10 is installed in the ceiling 42 by connecting or mounting the mounting frame 16 so that it is flush with the surface of the ceiling 42, as shown in FIG. 14. In other embodiments, the speaker system 10 is installed in the ceiling 42 by connecting or mounting the mounting frame 16 so that it is nearly flush with the surface of the ceiling 42, as shown in FIGS. 15*c* and 15*d*. In any regard, when installed in the ceiling 42, the intrusion of the speaker system 10 into the room 40 is minimized.

The speaker system 10 further includes a driver 12 housed by a driver chamber 14, which is attached to the mounting frame 16. According to the depicted embodiments, the driver chamber 14 is attached to the mounting frame 16 via a bridge 18, which is attached directly to the mounting frame 16 and to the driver chamber 14. The bridge 18 supports the driver chamber 14 such that the driver 12 is located centrally to the mounting frame 16 within the space of the top opening 20. In other embodiments, the driver chamber 14 attaches directly to the mounting frame 16, while still defining a top opening 20. In any regard, some of the top opening 20 remains open, i.e., the perimeter or circumference of the outer edge of the driver chamber 14 is less than the perimeter or circumference of the inner edge of the mounting frame 16. This still-open space of the top opening 20 allows for sound waves to pass from within the speaker system 10 into the room 40 in which the speaker system 10 is installed.

The driver 12, itself, is preferably a two-way combination of a tweeter within a midrange driver, as shown in the Figures. In other embodiments, the driver 12 is a one-way driver, such as a tweeter, a midrange, or a woofer, and, in still other embodiments, the driver 12 is a full-range driver. More particularly, the driver 12 may be any type of driver, whether one-way, two-way, or full-range. The driver 12 is arranged within the driver chamber 14 so as to be perpendicularly directed relative to the woofers 22, as shown in FIG. 1. In this way, the sound from the driver 12 is essentially directed into the room 40 into which the system 10 is installed, as indicated by arrow 32 in FIG. 9, and as shown in FIG. 14.

When installed, the mounting frame 16 is preferably essentially flush with the plane of the ceiling 42. In other embodiments, the mounting frame 16 is installed so as to be nearly flush with the plane of the ceiling 42, as shown in FIGS. 15*c* and 15*d*. The woofer housing 24 and woofers 22 sit above the mounting frame 16 and driver 12, within the ceiling 42. During operation, the plurality of woofers 22 produces a significant amount of bass. However, because the woofers 22 are oriented perpendicular to the plane of the ceiling 42, the diaphragm of each woofer 22 moves perpendicularly to the plane of the ceiling 42, as shown by arrows 52 in FIGS. 15*c* and 15*d*. Thus, the resulting, outwardly-moving vibrations 50 also move perpendicularly to the plane of the ceiling 42 and operate in a plane in which the ceiling 42 is least flexible such that the vibrations 50 will not transfer to the ceiling 42 or such that the resulting vibrations transferred to the ceiling 42 are to be minimized. In the known in-ceiling systems, such as that shown in FIGS. 15*a* and 15*b*, however, the back-and-forth movement (arrow 52') of the woofer 22' results in outwardly-moving vibrations that move in parallel to the plane of the ceiling 42 and thus operate in a plane in which the ceiling 42 is most flexible such that the vibrations transfer to the ceiling 42 and therefore vibrate or rattle it, as depicted in FIG. 15*b*.

Due to the arrangement of the woofers 22 being oppositely directed in each woofer 22 pair of the anti-vibration in-ceiling speaker system 10, the vibrations that each woofer 22 generates during operation are neutralized by another woofer 22, as depicted by arrows 54 in FIG. 15*d*. This, again, minimizes the rattling or vibration of the ceiling 42, itself, and the walls of the room 40. In addition, because the speaker system 10 is located almost entirely within the ceiling 42, a large amount of bass sound is generated in addition to the sound produced by the down-ward facing driver 12 without the aesthetic unpleasantness of a unit placed completely within the room.

The exemplary embodiments shown in the figures and described above illustrate, but do not limit, the anti-vibration in-ceiling speaker system. It should be understood that there is no intention to limit the system to the specific form disclosed; rather, the system is to cover all modifications, alternative constructions, and equivalents falling within the spirit and scope of the system as defined in the claims. For example, while the exemplary embodiments illustrate a speaker system for in-ceiling installation, the system may alternatively be installed in a wall, piece of furniture, automobile, or other location. While the system is not limited to installation within a ceiling, it is expected that various embodiments of the system will be particularly useful for in-ceiling installations. Hence, the foregoing description should not be construed to limit the scope of the system, which is defined in the following claims.

What is claimed is:

1. A speaker system configured for installation within a ceiling of a room, the speaker system comprising:

a woofer housing;

at least one pair of woofers oppositely directed away from one another, the woofers supported by the woofer housing;

a mounting frame supported by the woofer housing, the mounting frame configured to accommodate mounting the speaker system to the ceiling, the mounting frame defining a top opening;

a driver chamber supported by the mounting frame;

a driver supported by the driver chamber, the driver perpendicularly directed relative to the at least one pair of woofers, the driver comprising at least one of a tweeter, a woofer, a midrange driver, and a combination of a tweeter and a midrange driver;

the speaker system configured for installation substantially within the ceiling such that the at least one pair of woofers is disposed within the ceiling and each of the woofers of the at least one pair of woofers is directed toward an area within the ceiling, the top opening exposing an interior space defined by the woofer housing;

wherein, following installation, intrusion of the speaker system into the room is minimized; and wherein, during operation, vibrations generated by each of the woofers of the at least one pair of woofers is essentially neutralized by essentially-equal-and-opposite vibrations generated by another of the woofers of the at least one pair of woofers;

whereby the speaker system generates significant bass in a minimized space within the room and without heavily vibrating the ceiling.

2. The speaker system of claim 1, wherein the mounting frame comprises a plurality of sides, each of the sides defining a woofer opening, the woofer openings configured to receive therein one of the woofers.

3. The speaker system of claim 2, wherein the mounting frame further comprises a bottom.

4. The speaker system of claim 1, wherein the mounting frame is essentially rectangular in shape.

5. The speaker system of claim 1, wherein the mounting frame is essentially circular in shape.

6. The speaker system of claim 1, wherein the ceiling defines a plane; and each of the woofers of the at least one pair of woofers is oriented perpendicularly to the ceiling such that outwardly moving vibrations generated by each woofer of the at least one pair of woofers are directed perpendicularly to the plane.

7. A speaker system configured for installation within a ceiling of a room, the speaker system comprising:

a woofer housing;

two pairs of woofers, each of the pairs arranged so as to be oppositely directed, the pairs of woofers supported by the woofer housing;

a mounting frame supporting the woofer housing, the mounting frame configured to accommodate mounting the speaker system to the ceiling, the mounting frame defining a top opening;

a driver chamber supported by the mounting frame;

a driver supported by the driver chamber, the driver perpendicularly directed relative to the pairs of woofers, the driver comprising at least one of a tweeter, a woofer, a midrange driver, and a combination of a tweeter and a midrange driver;

the speaker system configured for installation substantially within the ceiling such that the top opening is essentially flush with the ceiling and such that the pairs of woofers are directed toward a space within the ceiling, the top opening exposing to the room an interior space defined by the woofer housing;

wherein, following installation, intrusion of the speaker system into the room is minimized; and wherein, during operation, vibrations generated by each of the woofers of the pairs of woofers are essentially neutralized by essentially-equal-and-opposite vibrations generated by another of the woofers of the pairs of woofers;

whereby the speaker system generates significant bass in a minimized space within the room and with minimized vibration of the ceiling.

8. The speaker system of claim 7, further comprising a bridge supported by the mounting frame, the bridge connecting the driver chamber to the mounting frame.

9. The speaker system of claim 7, wherein the mounting frame comprises a plurality of sides, each of the sides defining a woofer opening, the woofer openings configured to receive therein one of the woofers of the pairs of woofers.

10. The speaker system of claim 9, wherein the mounting frame further comprises a bottom.

11. The speaker system of claim 7, wherein the mounting frame is essentially rectangular in shape.

12. The speaker system of claim 7, wherein the mounting frame is essentially circular in shape.

13. An in-ceiling speaker system, comprising:

a speaker assembly comprising:

a speaker housing; and a plurality of drivers supported by the speaker housing;

the speaker assembly defining and isolating an interior space from an in-ceiling space, the interior space exposed to a room through at least one opening defined by the speaker assembly;

at least one of the plurality of drivers directed toward the room and comprising at least one of a tweeter, a woofer, a midrange driver, and a combination of a tweeter and a midrange driver; and others of the plurality of drivers directed toward the in-ceiling space, the others of the plurality being oppositely directed away from one another.

14. The in-ceiling speaker system of claim 13, wherein the at least one of the plurality of drivers directed toward the room consists of one driver of the plurality of drivers directed toward the room.

15. The in-ceiling speaker system of claim 13, wherein:

the at least one of the plurality of drivers directed toward the room comprises at least one of a tweeter, a midrange driver, and a combination of a tweeter and a midrange driver; and the others of the plurality of drivers directed toward the in-ceiling space comprise woofers.

16. The in-ceiling speaker system of claim 13, wherein the at least one of the plurality of drivers directed toward the room is disposed essentially centrally to the at least one opening defined by the speaker assembly.

17. The in-ceiling speaker system of claim 13, wherein each of the others of the plurality of drivers comprises a front side exposed to the in-ceiling space and a rear side exposed to the interior space.

* * * * *